US005231378A

United States Patent [19]

Dennis et al.

[11] Patent Number: 5,231,378

[45] Date of Patent: Jul. 27, 1993

[54] PARTICLE DETECTION WHICH SENSES SCATTERED LIGHT

[75] Inventors: Peter N. J. Dennis; Douglas E. Burgess, both of Malvern, United Kingdom

[73] Assignee: Kidde-Graviner Limited, Derby, England

[21] Appl. No.: 719,125

[22] Filed: Jun. 21, 1991

[30] Foreign Application Priority Data

Jun. 23, 1990 [GB] United Kingdom ..... 9014015

[51] Int. Cl.[5] ..... G08B 17/10

[52] U.S. Cl. ..... 340/630; 340/628; 250/574; 356/338

[58] Field of Search ..... 340/627, 628, 630; 250/573, 574, 575; 356/337, 338, 340, 341, 438

[56] References Cited

U.S. PATENT DOCUMENTS

| | | | |
|---|---|---|---|
| 4,186,390 | 1/1980 | Enemark | 340/630 |
| 4,226,533 | 10/1980 | Snowman | 356/338 |
| 4,232,307 | 11/1980 | Marsocci | 340/630 X |
| 4,397,557 | 8/1983 | Herwig et al. | 356/342 |
| 4,647,786 | 3/1987 | Guttinger et al. | 250/574 |
| 4,728,801 | 3/1988 | O'Connor | 340/630 X |
| 4,857,895 | 8/1989 | Kaprelian | 340/630 |
| 4,870,394 | 9/1989 | Corl et al. | 340/630 |
| 4,874,242 | 10/1989 | Bezard et al. | 340/602 X |

FOREIGN PATENT DOCUMENTS

| | | |
|---|---|---|
| 0011205 | 5/1980 | European Pat. Off. . |
| 0055319 | 7/1982 | European Pat. Off. . |
| 0099729 | 2/1984 | European Pat. Off. . |
| 0140502 | 5/1985 | European Pat. Off. . |
| 0208610 | 1/1987 | European Pat. Off. . |
| 1915906 | 11/1969 | Fed. Rep. of Germany . |
| WO84/02790 | 7/1984 | PCT Int'l Appl. . |
| 595851 | 2/1978 | Switzerland . |
| 1172353 | 11/1969 | United Kingdom . |
| 2003601 | 3/1979 | United Kingdom . |
| 2006955 | 5/1979 | United Kingdom . |
| 1560421 | 2/1980 | United Kingdom . |
| 2044504 | 10/1980 | United Kingdom . |
| 2047883 | 12/1980 | United Kingdom . |
| 2052732 | 1/1981 | United Kingdom . |
| 2097917 | 11/1982 | United Kingdom . |
| 2158573 | 11/1985 | United Kingdom . |
| 2163551 | 2/1986 | United Kingdom . |

*Primary Examiner*—Jin F. Ng
*Assistant Examiner*—Jeffery A. Hofsass
*Attorney, Agent, or Firm*—Leydig, Voit & Mayer

[57] ABSTRACT

A high sensitivity smoke detector comprises a cylindrical housing incorporating a sampling chamber through which air to be sampled is forced. A modulated light source, such as a laser, directs modulated light through the chamber to a beam dump. The light beam is offset from the axis of the housing by an acute angle of between 15 and 50 degrees. If any smoke particles are positioned within a sampling volume, the light is scattered along a path defined by baffles to an axially positioned light sensor whose electrical output is passed through a phase-sensitive detection circuit which is referenced by the frequency at which the light source is modulated, so as to produce an output dependent on the light scattered by the smoke particles.

6 Claims, 2 Drawing Sheets

PARTICLE DETECTION WHICH SENSES SCATTERED LIGHT

The invention relates to particle detection, and more specifically to apparatus for detecting particles such as smoke for example.

It is known to detect the presence of smoke in air by directing light through the air in a sampling chamber. A suitably positioned light sensor receives some of the light scattered from smoke particles in the air and provides an indication of the amount of smoke present in the air.

According to the invention, there is provided a high sensitivity detector of suspended particles in a gaseous medium and capable of detecting the presence of a concentration of particles in the medium which attenuate light by less than 1 per cent per meter of the medium, comprising: means defining a sampling region for receiving a sample of the gaseous medium; means for forcing a sample of the gaseous medium along a defined flow path including the sampling region; light source means operative when energised to direct a light beam along an input path to and through the region, such that light in the beam is scattered by particles in the medium in the region; light sensor means producing an output signal dependent on the light received and positioned to receive the scattered light along a predetermined output path from the said region; the light source means including beam confining means for defining the cross-sectional area and direction of the input path such that the beam passes through the region and into beam receiving means for receiving the beam and preventing its light from travelling back to the said region, the input path being offset from the output path by an angle between 15 and 50 angular degrees, and the beam receiving means comprising beam dump means positioned outside the defined flow path to receive unscattered light directly from the light source means and arranged to prevent substantially any reflection of such received light into the defined flow path; modulating means for modulating the intensity of the light in the light beam in a predetermined manner; and output means responsive only to corresponding modulation in the output signal of the sensor means, whereby to indicate the detection of the said particles.

According to the invention, there is also provided a detector of suspended particles in a gaseous medium, comprising: means defining a sampling region for receiving a sample of the gaseous medium; light source means operative when energised to direct a light beam along an input path to and through the region, such that light in the beam is scattered out of the input path by particles in the medium in the region; light sensor means producing an output signal dependent on light received and positioned in alignment with the input path; light blocking baffle means interposed between the input path and the light sensor means; and light directing means for receiving light scattered out of the input path by the said particles and for directing such scattered light to the light sensor means.

Smoke detecting apparatus embodying the invention will now be described, by way of example only, with reference to the accompanying drawings in which.

Figure 3:
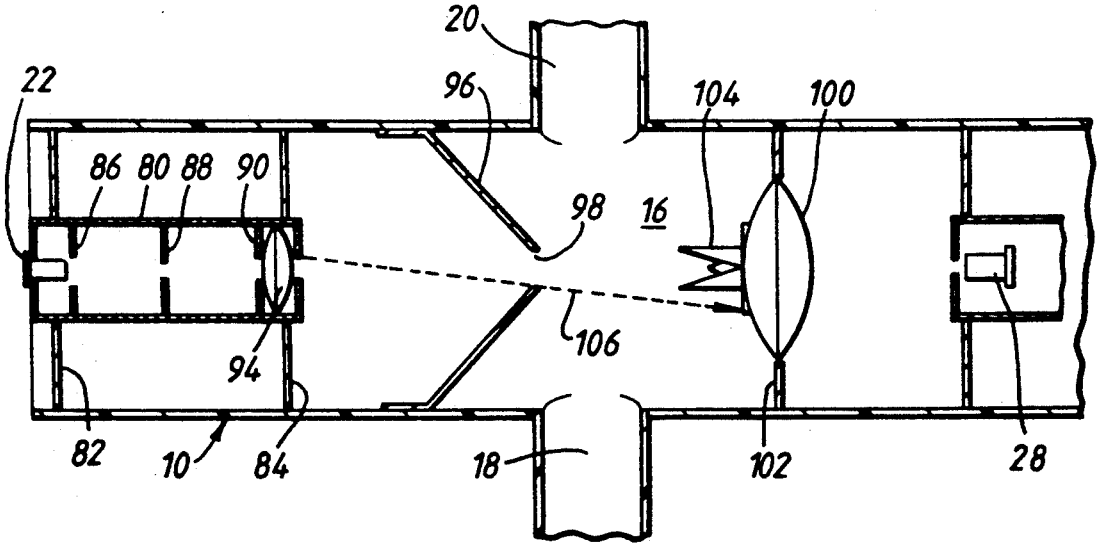

FIG. 3 schematically shows an axial cross-section through a further one of the smoke detectors.

Figure 1:
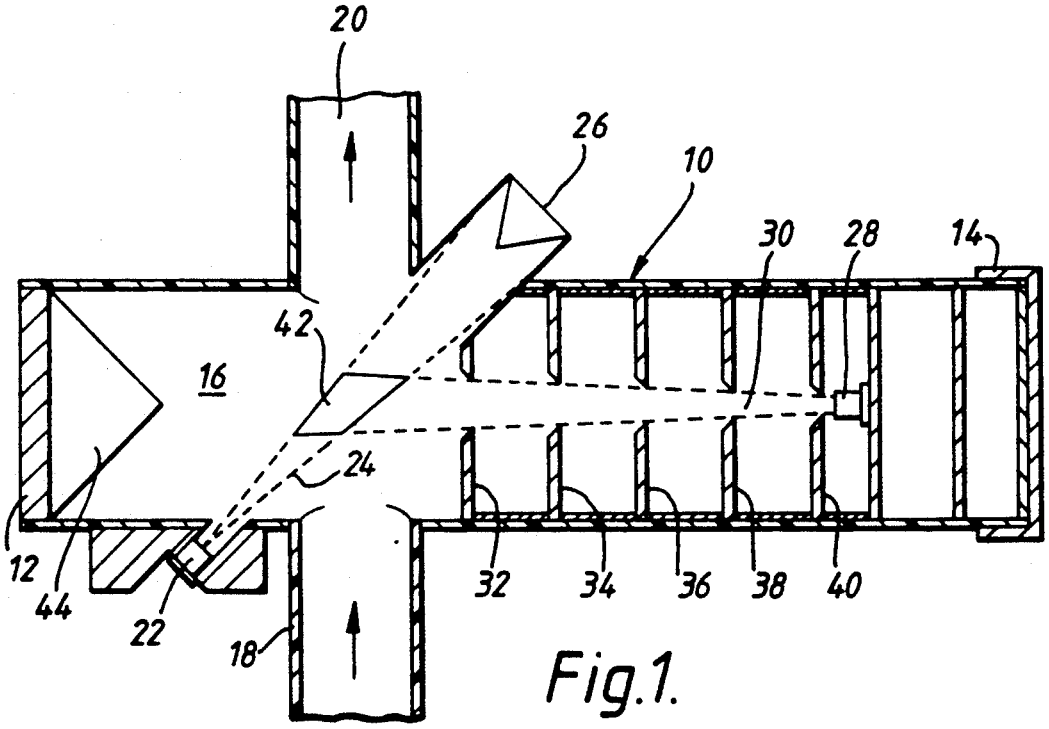
FIG. 1 is a schematic axial cross-section through one of the smoke detectors.

The smoke detector shown in FIG. 1 comprises a housing 10 of circular cross-section, such as formed in plastics and closed off at each axial end. As shown in the Figure, it is closed off at one end by a plug 12 and at the other end by an end cap 14. The closed-off housing provides an air sampling chamber 16 having diametrically opposed inlet/outlet apertures 18 and 20. Purely by way of example, the internal diameter of the housing 10 may be 58 mm. and each of the apertures 18,20 may have a diameter of 25 mm.

Air to be tested for the presence of any smoke particles is drawn into the sampling chamber 16 from outside by means of a fan or suitable pump (not shown), and any necessary associated pipe work, and passes through the chamber in the direction (in this example) of the arrows shown.

The housing 10 supports a light source 22. One example of a suitable light source is a laser. The light source 22 produces a light beam shown diagrammatically at 24 which passes obliquely across the chamber 10 to a beam dump arrangement 26. The design of the beam dump arrangement the sampling chamber 16. Reflection is minimised by so designing the beam dump arrangement that any reflection which does take place is multiple reflection which is confined within the beam dump arrangement and does not pass back into the sampling chamber. In addition, all internal surfaces of the housing 10 are painted matt black to minimise such reflection.

The housing 10 also incorporates a light sensor 28 which is mounted close to the end cap 14 and supported axially of the housing. Its field of view is indicated diagrammatically at 30 and is defined by five (in this example) annular baffle plates 32,34,36,38 and 40.

The light sensor 28 may be of any suitable form, such as an avalanche photo-diode.

The apertures defined by the baffles 32 to 40 may be (taken from left to right in the Figure) 8 mm., 7 mm., 6 mm., 5 mm. and 4 mm.

In use, air to be sampled is fed across the sampling chamber 16 in the direction of the arrows shown via the inlet and outlet apertures 18,20. The light beam 24 passes obliquely across the sampling chamber. In the absence of any particles within the air, the light beam will simply pass across the sampling chamber and enter the beam dump 26, and essentially none of the light will reach the light sensor 28. However, if any smoke particles are present in the sampled air, these, when present within a sampling volume indicated diagrammatically at 42, will cause some of the light to be scattered and to pass along the path 30 so as to be received and sensed by the light sensor 28 thus producing corresponding electrical output as will be more specifically described below.

The plug 12 carries a conical light stop 44 having a right angle at its vertex for preventing the reflection of any stray light along the path 30.

The direction of the light beam 24 is offset from the axis of the housing 10, and thus offset from the light path 30, by an acute angle lying between 15 and 50 degrees.

Figure 2:
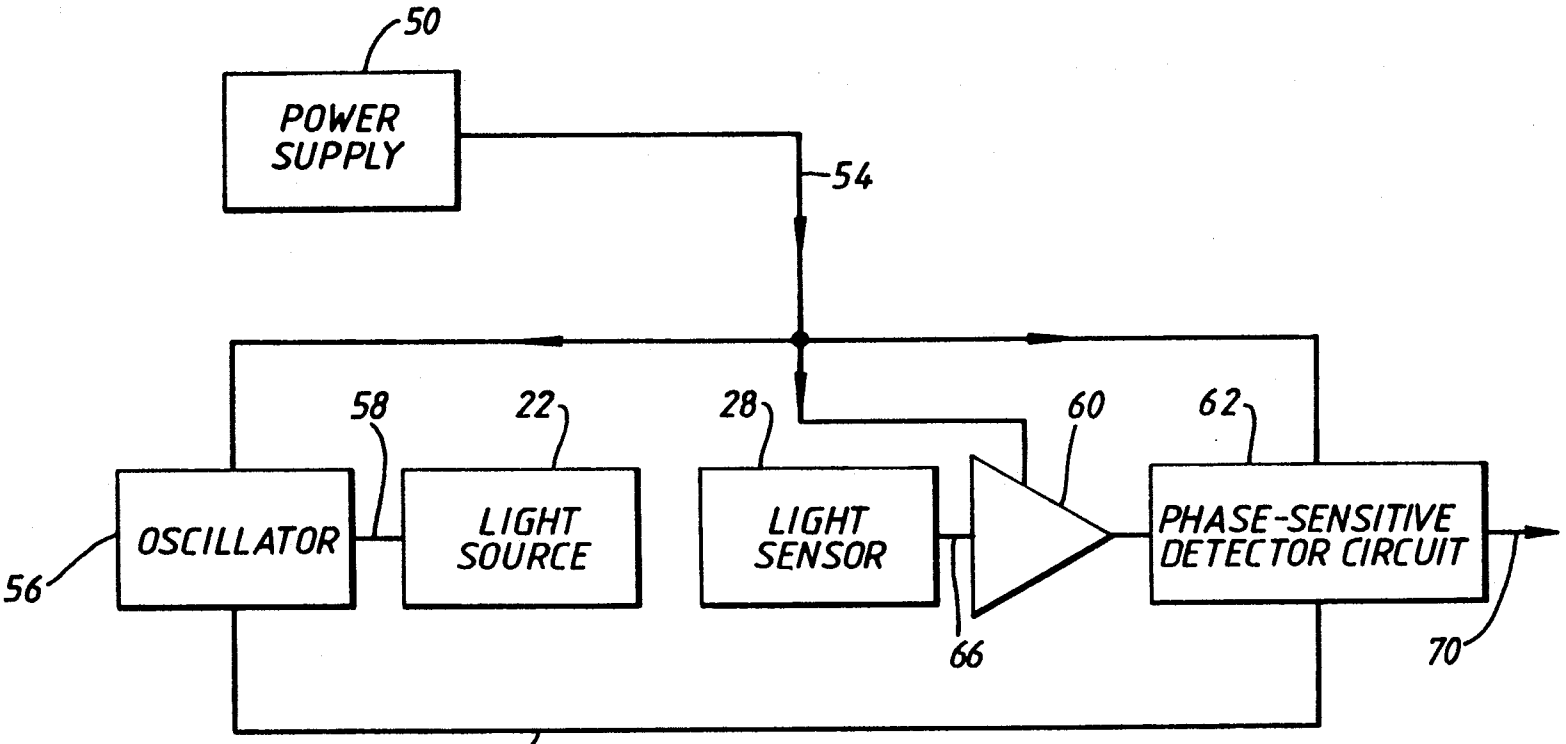
FIG. 2 is a block circuit diagram of the smoke detector of FIG. 1.

FIG. 2 illustrates the circuit diagram of the detector in block diagram form.

The circuit includes a power supply unit 50 producing an output voltage on a line 54 of suitable type and magnitude. Advantageously, the power supply is provide with a re-chargeable battery back-up (not shown).

The power supply 54 energises an oscillator circuit 56 which provides an output power supply at a predetermined frequency on line 58 to energise the light source 22 correspondingly. In addition, the power supply feeds an amplifier 60 and a phase-sensitive detector circuit 62 and also energises the light sensor 28 if it is of a type requiring such energisation.

In response to receipt of light, the light sensor 28 produces an electrical output on line 66 whose magnitude varies in frequency corresponding with the frequency of the amplitude variations of the received light. The electrical output is amplified by amplifier 60 and supplied to the phase-sensitive detector circuit 62. The phase sensitive detector 62 is supplied on a line 68 with a reference signal at the frequency of and in phase with the output of oscillator 56, this reference providing a frequency and phase reference for the phase-sensitive detector circuit 62. The latter therefore discriminates between output signals produced by the light sensor 28 as a result of receipt of scattered light from the light source 22 an output signals produced by the light sensor 28 as a result of light received from any other sources. The detector circuit 62 thus produces an output signal on a line 70 which is substantially only dependent on light scattered from the light source 22 and is substantially independent of stray light from any other sources.

The signal on line 70 may be fed to a central monitoring point.

The phase sensitive detector 62 may be replaced by a narrow bandwidth filter tuned to the frequency of the oscillator 56.

Alarm circuits may be provided, if required, to indicate failure of the light source and/or the fan or pump supplying air to the housing 10 and/or other components in the smoke detector.

FIG. 3 shows a modified form of the smoke detector. Items in FIG. 3 corresponding to those in FIGS. 1 and 2 are correspondingly referenced.

In the smoke detector of FIG. 3, the light source 22 is mounted in line with the light sensor 28. The light source 22 is supported in a sub-housing 80 which is itself supported within the housing 10 by brackets 82 and 84. Sub-housing 80 incorporates baffles 86,88,90 and 92 which define a light output path. As before, an example for light source 22 is a laser.

The sub-housing 80 may incorporate a lens 94 (as necessary according to the type of light source used) and this directs a light beam axially along the housing 10 towards and through a conical baffle arrangement 96 having a central aperture 98. A lens 100, of short focal length, is supported within the housing 10 by an annular wall 102 and is provided with a baffle arrangement 104 on its face which faces axially across the sampling chamber 16 towards the light source 22.

As before, air which may contain smoke particles to be detected, is pumped or otherwise drawn or blown through the sampling chamber 16 via inlet 18 and outlet 20.

In the absence of any particles within the air in the sampling chamber 16, the beam from light source 22 strikes the baffle arrangement 104 and is absorbed thereby or otherwise blocked from reaching the light sensor 28. Any reflection of such light is minimised by painting all the internal surfaces of the housing 10 matt black. The shape of the baffle arrangement 104, and also that of the conical baffle 96, ensures that any reflection which does take place cannot reach the light source 28.

However, if any smoke particles are present within the air in the sampling chamber 16, they will scatter some of the light from the light source 22 and cause it to be focussed by the lens 100 onto the light source 28.

The radial extent of the baffle arrangement 104 on the lens 100 should be such as to block off the ray of light indicated by the broken line 106.

The electrical circuit for the smoke detector of FIG. 3 may be of the same type as described with reference to FIG. 1.

What is claimed is:

1. A high sensitivity detector of suspended particles in a gaseous medium and capable of detecting the presence of a concentration of particles in the medium which attenuate light by less that 1 per cent per meter of the medium, comprising:

wall means defining an elongate chamber having a hollow interior;

means defining a flow path for the gaseous medium, the flow path extending through and across the chamber in a direction transverse to the latter's elongation and passing through an entrance aperture in the wall means and thence through an exit aperture therein, a portion of the flow path within the chamber constituting a sampling region;

means for forcing a sample of the gaseous medium through the entrance aperture and along the defined flow path and through the sampling region and thence through the exit aperture;

light source means fixedly mounted in relation to the chamber and operative when energized to direct a light beam along an input path which extends across the interior of the chamber in a direction transverse to the elongation of the chamber and also transverse to the defined flow path and passing to and through the sampling region, such that light in the beam is scattered by particles in the medium in the region;

light sensor means fixedly mounted in relation to the chamber and producing an output signal dependent on the light received and positioned to receive the scattered light along a predetermined output path from the said region;

the light source means including beam confining means for defining the cross-sectional area and direction of the input path such that the beam passes from the sampling region and into beam receiving means for receiving the beam and preventing its light from travelling back to the said region, the input path being offset from the output path by an angle between 15 and 50 angular degrees, and the beam receiving means comprising beam dump means fixedly mounted in relation to the wall means and positioned in rectilinear alignment with the light source and the sampling region and outside the defined flow path to receive unscattered light directly from the light source means and arranged to prevent substantially any reflection of such received light into the defined flow path;

modulating means for modulating the intensity of the light in the light beam in a predetermined manner;

output means responsive only to corresponding modulation in the output signal of the sensor means, whereby to indicate the detection of the said particles; and aperture defining means extending across the interior of the chamber transverse to its elongation and defining a plurality of apertures spaced apart along the length of the output path and each for defining the cross-sectional shape of the output path.

2. A detector according to claim 1, in which the beam dump means comprises surfaces geometrically juxtaposed such that any of the light in the beam which they reflect is not directed towards the defined flow path, the surfaces being substantially non-light-reflective.

3. A detector according to claim 1, in which the chamber is generally cylindrical, and the output path extends substantially axially within the interior of the chamber, the flow path intersecting the output path and the intersection of the output path with the flow path defining the said sampling region.

4. A detector according to claim 1, in which the light source means is positioned adjacent one of the ends of the chamber and the light sensor means being positioned adjacent the other end of the chamber, the aperture defining means comprising baffles extending across the interior of the chamber and respectively defining the said apertures, and the means defining the flow path being positioned between the light source means and the light sensor means.

5. A detector according to claim 1, in which the modulating means comprises means for electrically modulating the light source means with a predetermined modulation, and in which the light sensor means produces an electrical output which is processed by a phase-sensitive output circuit to which the modulation signal is supplied as a reference.

6. A detector according to claim 1, in which the modulating means comprises means for electrically modulating the light source means with a predetermined modulation, and including an amplifier responsive to the output of the light sensor means and having a narrow bandwidth filter to amplify only the component of the electrical output having the frequency of the predetermined modulation.

* * * * *